United States Patent [19]

Penton

[11] 4,000,882

[45] Jan. 4, 1977

[54] CONTRASTING MARKER PANEL FOR HIGHWAY GUARDRAILS AND THE LIKE

[75] Inventor: Hugh V. Penton, San Marino, Calif.

[73] Assignee: California Metal Enameling Company, Los Angeles, Calif.

[22] Filed: Aug. 28, 1975

[21] Appl. No.: 608,516

[52] U.S. Cl. ..... 256/13.1

[51] Int. Cl.[2] ..... A01K 3/00

[58] Field of Search ..... 256/13.1; 404/6, 8, 404/9, 16; 114/219; 350/97, 101, 102, 107

[56] References Cited

UNITED STATES PATENTS

| | | | |
|---|---|---|---|
| 3,214,142 | 10/1965 | Brown et al. | 256/13.1 |
| 3,332,327 | 7/1967 | Heenan | 404/16 |
| 3,411,304 | 11/1968 | Miller | 114/219 |

FOREIGN PATENTS OR APPLICATIONS

| | | | |
|---|---|---|---|
| 1,567,601 | 4/1969 | France | 256/13.1 |

*Primary Examiner*—Werner H. Schroeder
*Assistant Examiner*—Doris L. Troutman
*Attorney, Agent, or Firm*—Mahoney, Schick & Cislo

[57] ABSTRACT

The marker panel is preferably formed internally of force crushable material and has side and rearward surfaces thereof conforming to surfaces of the U-shaped recess of a conventional metal guardrail so that the marker panel may be preferably adhesively secured fully within the guardrail recess. An exposed generally vertical front surface of the marker panel is preferably covered with a plastic film, sometimes reflectorized, and a reflector or reflectors may, in certain instances, be mounted angularly in this front surface or on angular ends of the marker panel so as to be exposed outwardly of the guardrail recess.

10 Claims, 8 Drawing Figures

Fig. 5.
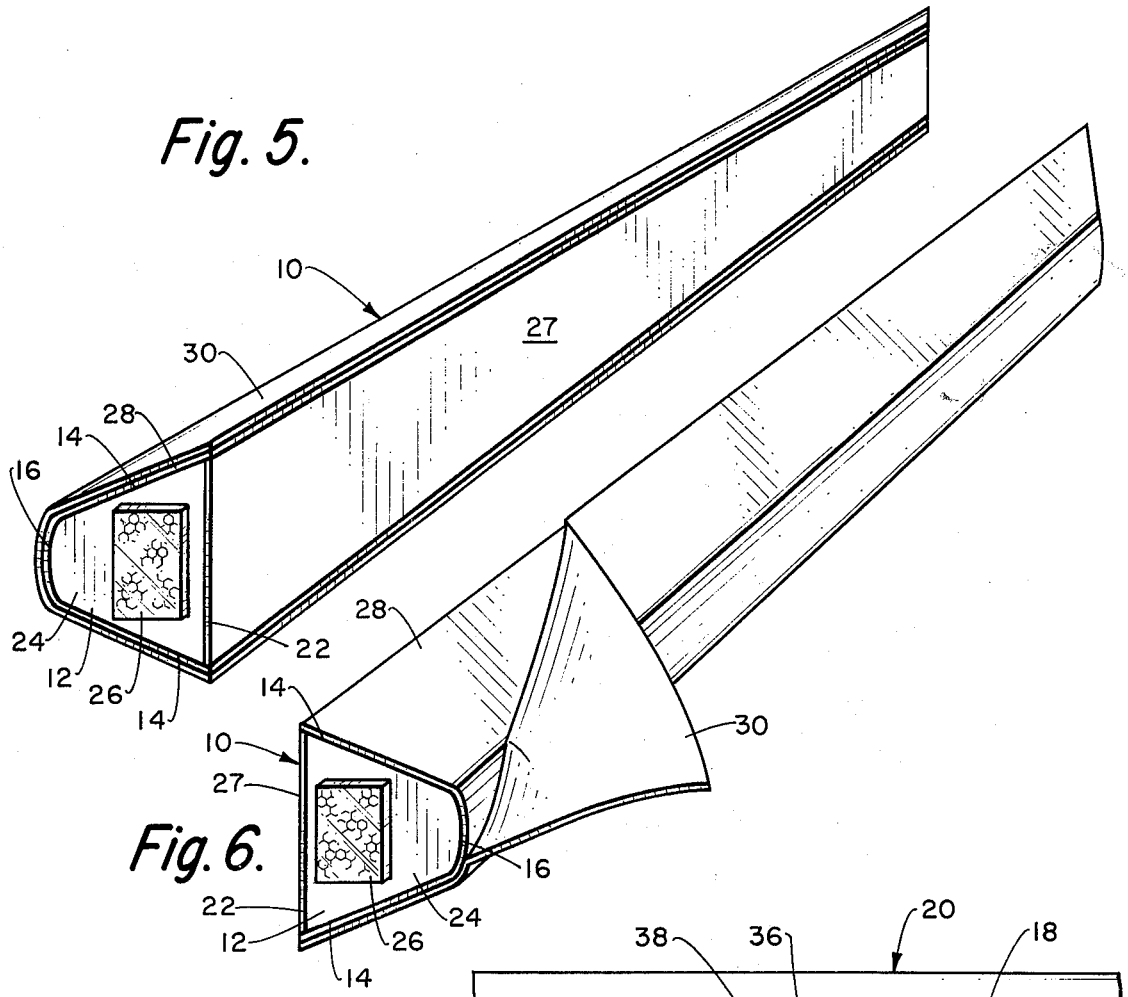
Fig. 6.
Fig. 7.
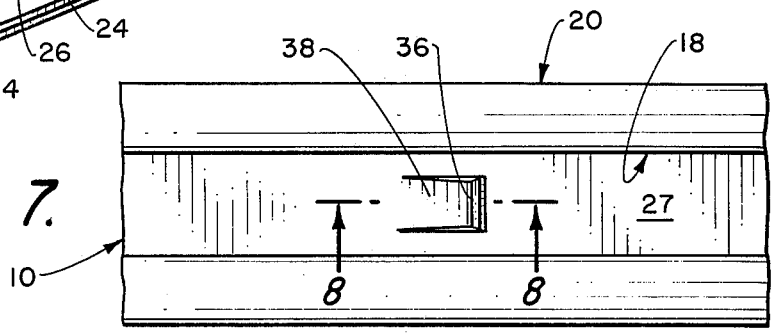
Fig. 8.
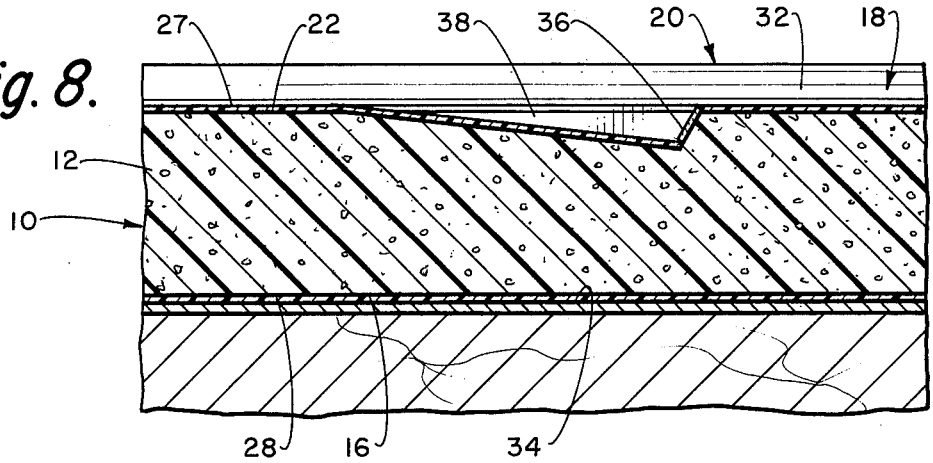

CONTRASTING MARKER PANEL FOR HIGHWAY GUARDRAILS AND THE LIKE

BACKGROUND OF THE INVENTION

This invention relates to a construction of a contrasting marker panel for highway guardrails and the like, and a method of forming the same. More particularly, this invention relates to a marker panel which may be mounted preferably totally within the generally longitudinally extending and generally U-shaped cross section recess of conventional highway guardrails so that the front surface of the marker panel within the guardrail recess is exposed transversely of highway traffic flow. Furthermore, certain contrasting surface portions in the form of colors and/or reflectorized surface portions are provided on the marker panel which are exposed outwardly of the guardrail recess to thereby form a contrasting indication of the guardrail marked highway limits fully visible against highway surrounding background to vehicles traveling the adjacent highway.

The use of longitudinally continuous guardrails along highways including centrally of the highways for separating oppositely flowing traffic thereon in modern highway design is quite well known. Such use is particularly frequent in and around urban areas due to greatly increased traffic congestion and vehicle intensity in order to maximize travel safety. Furthermore, in the case of freeways and turnpikes, the use of continuous guardrails is almost an absolute necessity.

Probably the most commonly used form of continuous guardrail is that formed of sheet iron or steel contoured with longitudinally continuous and somewhat arcuately formed upper and lower projections vertically separated by a somewhat U-shaped recess. These metal guardrails are supported on spaced, usually wooden, supporting posts and are quite effective in reasonably resisting penetration by vehicles, particularly when contacted at an angular or somewhat glancing force. With the particular contouring of these guardrails, not only can the guardrails be formed relatively strong without the use of prohibitive metal thicknesses, but the somewhat smooth contour thereof tends to redirect a vehicle contacting the same back onto the adjacent highway in many cases with far lesser damage to the vehicle than has been possible with common barrier posts with cable reinforcing and the like.

It is also well known in modern highway design to make increasingly more frequent use of various types of markers, sometimes including reflectors, in order to increase directional visibility for the vehicle drivers by providing a discernible contrast between the highway and the adjacent land areas. The use of such reflectors is particularly effective during night hours where there is a minimum amount of light for visibility and become even more valuable during rainy and otherwise inclement weather conditions where normal visibility is minimal. For instance, there is presently quite extensive use, particularly on freeways and turnpikes where speeds of vehicles are in the higher ranges, of reflectorized traffic lane marking wherein reflectorized pads are mounted at spaced locations along and aligned with the traffic lane stripes which not only provide increased visibility for a vehicle driver in order that such driver may maintain his vehicle properly aligned with a given traffic lane, but upon the vehicle moving out of its particular traffic lane, the vehicle passing over the reflectorized pads gives a noise indication that the vehicle has assumed such directional movement from a given traffic lane.

In order to even further enhance this reflectorization concept relative to highway design and provide even increased vehicle safety for further reducing both property damage and human injury, it has become highly desirable to provide equivalent reflectorized marking of the side highway guardrails. In this manner, not only will the vehicle lanes with their present reflectorized marking be more clearly visible during night and inclement weather conditions, but the side limits of the highways will be equally as well marked and visible so that the vehicle drivers may remain at all times more fully oriented as to approaching directional changes of the highways. With the reflectors picking up and reflecting minimum light at quite extensive distances, the pattern of the path of the highway is quite apparent to the vehicle driver at quite great distances even under the minimum light conditions and at the present-day vehicle speeds so that approaching highway directional conditions are more clearly apparent to the vehicle driver and can be more easily anticipated.

The reflectorization of the highway guardrails has, however, presented certain basic difficulties. Keeping in mind that the above-described metal guardrails are deliberately designed to present a relatively smooth surface for a vehicle contacting the same in order to minimize damage to the vehicle and ultimately to its occupants, it becomes a problem as to just how to mount reflectors thereon without partially destroying the guardrail smooth attributes. Furthermore, since the guardrails are at the sides of the highway so as to be spaced transversely from the normal vehicle longitudinal flow, reflectors mounted flatwise merely against the guardrail surfaces will only have a minimal effect of collecting and reflecting light from and to the vehicles traveling the highway lanes.

OBJECTS AND SUMMARY OF THE INVENTION

It is, therefore, an object of this invention to provide a contrasting marker panel for highway guardrails and the like which is particularly adapted for mounting in the presently installed and most commonly used metal guardrails without destroying the design incorporated safety attributes of such guardrails as hereinbefore described. According to the principals of the present invention, the unique marker panels are mounted fully within and preferably recessed within the continuous central recesses of the guardrails. Furthermore, the marker panels preferably are shaped to conform to the guardrail recess surfaces vertically spanning the guardrail recesses and extending to an extensive guardrail recess depth and preferably the full depth thereof.

It is a further object of this invention to provide a contrasting marker panel for highway guardrails and the like having the foregoing unique attributes and which is designed for presenting relatively smooth surfaces even in the described recessed position to again assure the maintenance of the inherent guardrail safety features while at the same time, providing convenient surfaces upon which contrasting colors and/or reflectorized surfaces may be mounted and are fully visible outwardly of the guardrails. The marker panels may be formed in relatively short sections so as to present frequent exposed end surfaces or the marker panels may be formed in quite long sections, but still presenting generally vertically extending exposed face or front surfaces. Thus, contrasting surfaces may be mounted on panels in either or both of these exposed surface positions, at the ends thereof or on the exposed face surfaces thereof in order to obtain the desired discernible contrasting marking along the guardrails and against the adjacent land background.

It is still a further object of this invention to provide a contrasting marker panel for highway guardrails and the like which, in one preferred form thereof, presents various reflectorized surface portions or reflectors mounted on the surfaces thereof in the maximum light reflecting positions of high visibility to the drivers of vehicles traveling on the adjacent highways. Certain of the reflectorized surface portions or individual reflectors may be mounted on the marker panels at spaced locations therealong in design predicated angular positions so that the light from the adjacent highway is reflected back toward the moving vehicle to a maximum extent. Where the reflectorized surface portions are mounted on the marker panel end surfaces, the end surfaces are so angularly formed so that conventional surface coverings or conventional reflectors may be mounted thereon and will assume the predicated angular positions. Where the reflectorized surface portions or reflectors are mounted on the face or front surfaces of the marker panels, the surfaces upon which they are mounted are angularly recessed, again at the predicated design angle to likewise adapt conventional surface coverings or reflectors for use thereon.

It is also an object of this invention to provide a contrasting marker panel for highway guardrails and the like highly advantageous for its intended purpose as hereinbefore described, yet which may be provided at a relatively low cost of material and which material very importantly can increase the safety features thereof. Furthermore, in one preferred form thereof, the marker panel may be quickly and conveniently mounted in the recesses of presently installed guardrails so as to reduce the labor costs and thereby the overall costs of adding the highly desirable safety features. The marker panel of the present invention may preferably be formed internally thereof of a force crushable material so that if the panel is impacted by a vehicle striking the guardrail, there is not damaging resistance to the vehicle beyond that normally provided by the guardrail alone. Also, the marker panel may be relatively permanently mounted in the guardrail recess by use solely of adhesive so as to eliminate the necessity of any additional fastening means such as bolts and the like which could not only present dangerous guardrail projections destroying the smooth surface concept thereof, but which would require extensive time and labor for the marker panel mounting.

Other objects and advantages of the invention will be apparent from the following specification and the accompanying drawings which are for the purpose of illustration only.

BRIEF DESCRIPTION OF THE DRAWINGS

FIG. 5 is a front-end perspective view of the embodiment of marker panel of FIGS. 1 through 4 removed from the guardrail and having adhesive covered by a release paper mounted thereon ready for installation in a metal guardrail;

FIG. 6 is a rear-end perspective view of the marker panel of FIG. 5 being prepared for guardrail mounting by the removal of the release paper covering the adhesive;

FIG. 7 is a fragmentary, side elevational view of a second embodiment of the marker panel of the present invention mounted in a conventional metal guardrail; and FIG. 8 is an enlarged, fragmentary, horizontal sectional view looking in the direction of the arrows 8—8 in FIG. 7.

DESCRIPTION OF THE BEST EMBODIMENTS CONTEMPLATED

Figure 1:
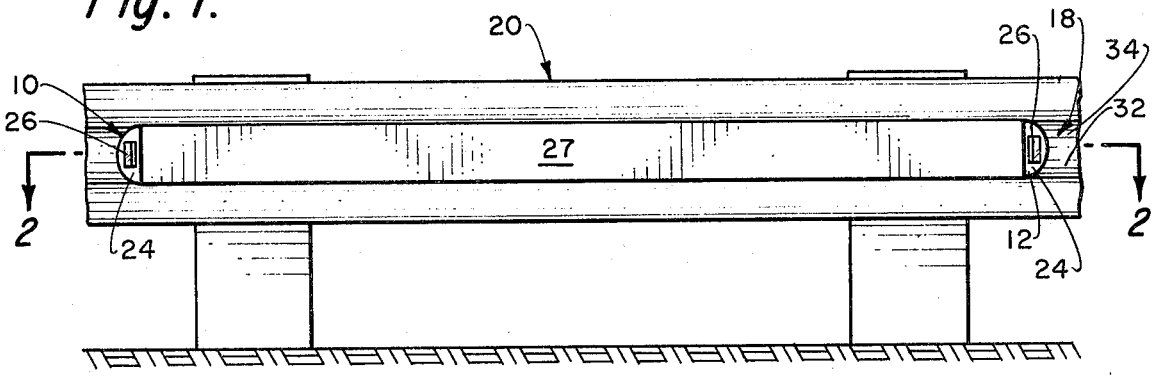
FIG. 1 is a fragmentary, side elevational view of a conventional metal guardrail having one embodiment of the contrasting marker panel of the present invention mounted thereon.
Figure 2:
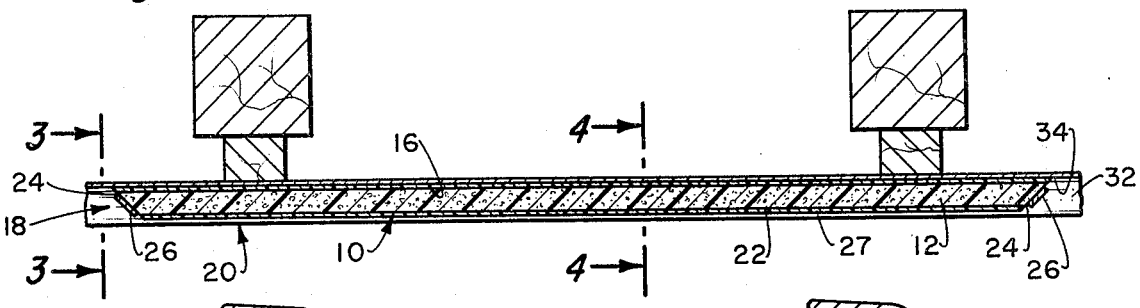
FIG. 2 is a fragmentary, horizontal sectional view looking in the direction of the arrows 2—2 in FIG. 1.
Figure 3:
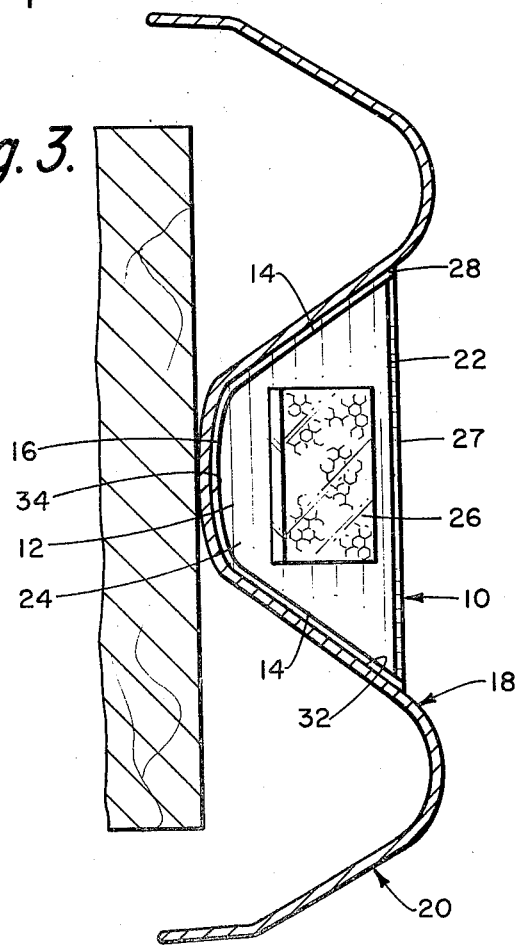
FIG. 3 is an enlarged, fragmentary, vertical sectional view looking in the direction of the arrows 3—3 in FIG. 2.
Figure 4:
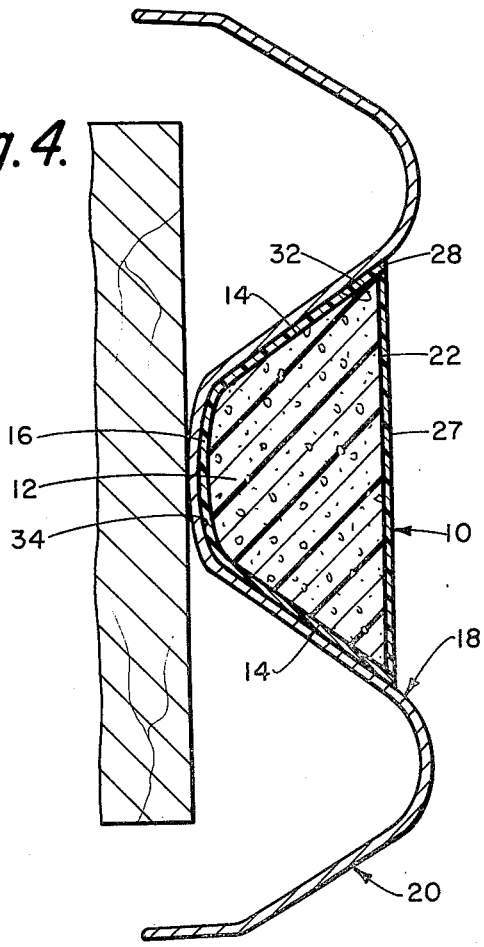
FIG. 4 is an enlarged, fragmentary, vertical sectional view looking in the direction of the arrows 4—4 in FIG. 2.

Referring to FIGS. 1 through 6 of the drawings, one embodiment of the preferred form of contrasting marker panel of the present invention is shown therein generally indicated at 10 and includes a generally longitudinally extending or longitudinally elongated main body 12 which is preferably basically formed by as well as internally thereof from a force crushable material. By the term "force crushable material" it is intended to mean a material which is relatively easily crushable upon contact by a rigid member such as the rigid metal members of the various forms of vehicles and the like. To serve its intended purpose, the main body 12 of the marker panel 10 need not necessarily be permanently crushable, for instance, the main body could be formed of many of the expanded foam plastics such as a closed cell polyurethane and in such case the main body would be permanently crushable, or the main body could be formed of one of the resilient foam rubbers or foam plastics in which case the main body would only be temporarily crushable, the purpose of this crushable feature to be hereinafter explained.

As shown, the main body 12 also includes a transverse or vertical generally U-shaped cross section having slightly angled, vertically opposite side surfaces 14 rearwardly joined by a somewhat arcuate rearward surface 16. As will be hereinafter further explained, this generally U-shaped vertical cross-sectional shape of the main body 12 is preferably throughout the longitudinal length thereof uniformly and is predicated in size to be relatively closely conforming to at least a major portion of a recess generally indicated at 18 of a conventional metal highway guardrail generally indicated at 20, also to be hereinafter described more in detail. The vertical cross-sectional shape of the main body 12 is completed by a generally vertically extending forward surface 22 vertically spanning the forward extremeties of the side surfaces 14.

With the marker panel 10 being unitary, longitudinally opposite end surfaces 24 thereof are formed oppositely angled, that is, angled from the rearward surface 16 oppositely longitudinally inwardly to the forward surface 22 so that these end surfaces partially face transversely toward the transverse forward direction or in the forward facing direction of the forward surface 22. Although merely a background contrasting surface portion, reflectorized or unreflectorized, may be used, in this case, a conventional plastic or glass reflector 26 is mounted on each of the main body end surfaces 24 preferably by adhesively securing the same, the reflectors shown being generally rectangular in face configuration and relatively thin with the reflective surfaces thereof generally parallel to the end surfaces. The basic marker panel 10 is completed by adhesively securing a guardrail and surrounding area contrasting plastic film 27, such as a polycarbonate plastic film, covering the main body forward surface 22, the preferred contrasting coloration thereof as well as the preferred contrasting coloration of the end surface reflectors to be hereinafter discussed.

As stated, the foregoing basically completes the marker panel 10, but in order to prepare the same for mounting in the recess 18 of the guardrail 20 according to the preferred method of the present invention, an adhesive layer 28 is applied to preferably the entire of the main body side and rearward surfaces 14 and 16. This adhesive layer 28 is preferably one of the well-known pressure sensitive adhesives of a composition compatible with the surfaces of both the main body 12 and the guardrail 20 in order to perform an intended mounting function to be hereinafter described. For instance, the adhesive layer 28 may be of a butyl adhesive. Furthermore, until actual mounting of the marker panel 10 in the recess 18 of the guardrail 20 is intended, the adhesive layer 28 is preferably covered with usual selectively removable release paper 30.

With the marker panel 10 thusly constructed and prepared for mounting, the marker panel may be quickly and easily virtually permanently mounted in the recess 18 of the conventional metal guardrail 20 merely by first removing the release paper 30 covering the adhesive layer 28 as illustrated in FIG. 6 and then inserting the marker panel fully into the guardrail recess pressing the same tightly against complementary side and rearward surfaces 32 and 34 of the guardrail recess 18 into the position shown in FIGS. 1 through 4. As so mounted, with the marker panel end surfaces 24 being angled as described with the contrasting surface portions or the reflectors 26 thereon, such surface portions or reflectors will then be fully visible outwardly of the guardrail 20 as will be the preferably contrasting forward surface plastic film 27 of the marker panel 10.

It is preferred, for maximum visibility and directional indication to vehicles traveling a highway (not shown) transversely faced by the guardrail recess 18 and the marker panel 10 therein, the highway extending longitudinally parallel to the longitudinal extension of the guardrail 20, to provide the contrasting plastic film 27 on the marker panel forward surface 22 colored yellow so as to fully contrast and be readily discernible from the background land areas adjacent the sides of the highway. Furthermore, it is preferred to provide the surface portion or the reflector 26 on the marker panel end surface 24 longitudinally trailing the longitudinal extension of the marker panel or generally facing the oncoming flow of vehicles on the highway white or yellow with the opposite surface portion or reflector on the marker panel leading end colored red.

Thus, by similarly mounting a multiplicity of the marker panels 10 at spaced locations along the guardrail 20, the white reflectors 26 will be of a clear reflective indication or marking of the side of the particular highway most importantly apparent both in daylight through contrasting coloration thereof and at night and during inclement weather by reflecting the light of vehicle headlights and other minimum light from the surrounding area. Furthermore, with the red end reflector 26 at leading ends of the marker panel 10, such will clearly indicate to a wrong direction traveling vehicle that such direction is wrong. Obviously, these marker panels 10 according to the present invention may be relatively easily mounted in the recesses 18 of existing guardrails 20 merely by first cleaning the guardrail surfaces and then following the mounting procedure hereinbefore described, such operation being capable of performance very quickly and with a minimum of interruption of vehicle travel on the particular adjacent highway.

Although it is, of course, dependent on the particular longitudinal extension of the guardrail 20 relative to an adjacent highway, where the highway extends longitudinally parallel to the guardrail, it is believed that the contrasting surface portions such as the reflective surfaces of the reflectors 26 should be at an angle in the order of 23° from perpendicular to the longitudinal extension of the guardrail and adjacent highway for normal traveled highway marking. In the case of the usual on-ramps to freeways and turnpikes, where it is desirable to provide a short distance of indication for such oncoming vehicles, the angling can be increased so as to be in the order of 45° from perpendicular. It should, however, be kept in mind that although a certain amount of angling is required for maximum reflective visibility, such angling will depend on the particular conditions present.

Finally, and keeping in mind the advantages of the modern metal guardrails 20 having the smooth surfaces thereon to minimize vehicle damage and injury to vehicle passengers as hereinbefore discussed, the advantages of the main body 12 of the marker panel 10 being formed of force crushable material at least internally thereof can be readily appreciated whether the main body projects from the guardrail recess or is fully recessed therein. With such force crushable material, a vehicle accidentally impacting the guardrail 20 and even penetrating the guardrail recess 18 will not in any way be obstructed beyond the usual obstruction caused by the guardrail along since the comparatively slight forces required for such marker panel crushing will have virtually no effect as to obstructing the vehicle movement. Although the use of this force crushable material for the main body 12 is considered to be optimum relative to the present invention, it is pointed out that various other materials could be used either to produce similar results or lesser optimum results, and all such forms of construction are intended to be included in the broad principle of the present invention. Furthermore, it is preferred that the main body material will be somewhat flexible so as to more easily conform to the guardrail surfaces where slightly irregular.

Referring to the alternate embodiment form shown in FIGS. 7 and 8, where it is desirable to provide the marker panels 10 of extensive longitudinal lengths wherein the end surfaces 24 with their reflectors 26 will be far less frequent, it may be desirable to angularly mount reflectorized contrasting surface portions such as the rectangular reflectors 36 in angled pockets 38 formed directly in the main body forward surface 22. In other words, the marker panel 10 may be virtually identically formed, but with the addition of the pockets 38 embossed or otherwise formed in the main body forward surface 22 and the surface portions or reflectors 36 adhesively secured in the positions shown angled facing the oncoming flow of vehicle traffic on the adjacent highway. In this manner, reflective markings intermediate the marker panel lengths would be provided serving the same directional function as hereinbefore discussed.

Throughout the foregoing, the term "contrasting" and "contrasting surface portion" has been used and such has been equated to both reflectorized and unreflectorized surface portions, as well as individual reflectors. It should be understood that the terms including the term "contrasting" are meant to mean contrasting, discernible or distinguishable from the surrounding background such as is found at or adjacent highway borders including the guardrail itself, or background adjacent bushes and trees, or bridge abutments and similar adjacent commonly found background. At the same time, the contrasting surface portions may be in the form of paints, surface coatings or coverings, stripes, reflectorized surfaces, unreflectorized surfaces, individual reflectors and similar as long as capable of serving the contrasting purposes under the desired particular conditions.

Furthermore, with the marker panel of the present invention as described and mounted, these marker panels are easily cleaned and even "self cleaning" from the normal rainy weather conditions so that the contrasting qualities thereof will be retained. Still further, with the preferred crushable qualities thereof, they may be mounted over guardrail protrusions, such as bolt heads, and will readily conform to the guardrail surfaces. Finally, although in one preferred form, adhesive is used for fastening, various common fastening means may be used, such as metal or plastic bolts, in any of the marker panel fastening operations as the conditions dictate.

Thus, according to the principles of the present invention, preferred embodiments of a contrasting marker panel for highway guardrails and the like is provided which advantageously serves to increase the safety for vehicles traveling the adjacent highways. By the use of the unique marker panels mounting contrasting surface portions including reflectors thereon, the surfaces are conveniently positioned along the guardrails fully visible through the contrasting and/or reflective qualities thereof by vehicles using the highway so as to clearly mark the transverse limits of the highway and increase the safety of use of the same both in daylight and most importantly in night and inclement weather conditions. Furthermore, with the unique construction of the marker panels and the method of mounting the same on conventional guardrails, installation costs are reduced to a minimum and marker panel mounting can be quickly and easily accomplished with a minimum interruption of vehicle traffic along adjacent highways.

I claim:

1. In a contrasting marker panel for highway guardrails and the like, the guardrails being of the type having a generally U-shaped cross section recess therein extending continuously longitudinally thereof and generally transversely facing traffic flow; the marker panel comprising: a longitudinally extending main body having a generally vertical front surface and vertically spaced, upper and lower side surfaces; said body being at least internally formed of force crushable material; said body side surfaces being located generally conforming to and abutable against complementary surfaces of the guardrail recess with said body totally within and vertically spanning said recess, said body front surface being located spaced rearwardly of forward extremities of said recess; securement means for fastening said body totally within said guardrail recess; contrasting surface portions on said main body exposed generally forwardly of said main body and the guardrail and clearly distinguishing from the guardrail when said main body is fastened within said guardrail recess, said body contrasting surface portions comprising a majority of body surfaces exposed generally forwardly of said body and said guardrail.

2. In a contrasting marker panel as defined in claim 1 in which said main body force crushable material compresses and conforms surfaces of said body to any obstructing protrusions in said guardrail recess during said fastening of said body within said guardrail recess.

3. In a contrasting marker panel as defined in claim 1 in which all of said body side surfaces and a rearward surface are formed generally conformable to complementary surfaces of the guardrail recess when said main body is positioned within said guardrail recess with said body front surface spaced rearwardly of said forward extremities of said recess.

4. In a contrasting marker panel as defined in claim 1 in which all of said body side surfaces and a rearward surface are formed generally conformable to complementary surfaces of the guardrail recess when said main body is positioned within said guardrail recess with said body front surface spaced rearwardly of said forward extremities of said recess; and in which said securement means includes adhesive on certain of said body side and rearward surfaces.

5. In a contrasting marker panel as defined in claim 1 in which said securement means includes adhesive at least on a majority of said body side surfaces; and in which release paper is positioned outwardly covering said adhesive selectively removable prior to adhesive fastening of said body within said guardrail recess.

6. In a contrasting marker panel as defined in claim 1 in which all of said body side surfaces and a rearward surface are formed generally conformable to complementary surfaces of the guardrail recess when said main body is positioned within said guardrail recess with said body front surface spaced rearwardly of said forward extremities of said recess; in which said securement means includes adhesive on certain of said body side and rearward surfaces; and in which release paper is positioned outwardly covering said adhesive selectively removable prior to fastening said body within said guardrail recess.

7. In a contrasting marker panel as defined in claim 1 in which said main body front surface has a covering of contrasting plastic film clearly distinguishing from the guardrail.

8. In a contrasting marker panel for highway guardrails and the like, the guardrails being of the type having a generally U-shaped cross section recess therein extending continuously longitudinally thereof and generally transversely facing traffic flow; the marker panel comprising: a longitudinally extending main body having a generally vertical front surface and vertically spaced, upper and lower side surfaces; said body side surfaces being located generally conforming to and abutable against complementary surfaces of the guardrail recess with said body within and vertically spanning said recess; securement means for fastening said body within said guardrail recess; at least a certain contrasting surface portion on said main body exposed generally forwardly of said main body and the guardrail when said main body is fastened within said guardrail recess; said main body including generally longitudinally and oppositely facing end surfaces; said main body contrasting surface portion including a reflectorized surface portion mounted on at least one of said body end surfaces forwardly angularly exposed of both said main body and the guardrail when said main body is fastened within said guardrail recess.

9. In a contrasting marker panel as defined in claim 8 in which all of said body side surfaces and a rearward surface are formed generally conformable to complementary surfaces of the guardrail recess when said main body is positioned within said guardrail recess; and in which said main body is at least internally formed of generally force crushable material.

10. In a contrasting marker panel for highway guardrails and the like, the guardrails being of the type having a generally U-shaped cross section recess therein extending continuously longitudinally thereof and generally transversely facing traffic flow; the marker panel comprising: a longitudinally extending main body having a generally vertical front surface and vertically spaced, upper and lower side surfaces; said body side surfaces being located generally conforming to and abutable against complementary surfaces of the guardrail recess with said body within and vertically spanning said recess; securement means for fastening said body within said guardrail recess; at least a certain contrasting surface portion on said main body exposed generally forwardly of said main body and the guardrail when said main body is fastened within said guardrail recess; said main body contrasting surface portion including at least one reflectorized surface portion mounted on said main body front surface forwardly angularly exposed of said main body and the guardrail when said main body is fastened within said guardrail recess.

* * * * *